US009839831B2

(12) United States Patent
Brown et al.

(10) Patent No.: US 9,839,831 B2
(45) Date of Patent: Dec. 12, 2017

(54) PROTECTIVE SPORTS GLOVE

(71) Applicants: Austin Brown, Hanover, PA (US); Michael Cox, Baltimore, MD (US)

(72) Inventors: Austin Brown, Hanover, PA (US); Michael Cox, Baltimore, MD (US)

(73) Assignee: WM. T. BURNETT IP, LLC., Baltimore, MD (US)

( * ) Notice: Subject to any disclaimer, the term of this patent is extended or adjusted under 35 U.S.C. 154(b) by 22 days.

(21) Appl. No.: 14/080,097

(22) Filed: Nov. 14, 2013

(65) Prior Publication Data

US 2014/0143926 A1 May 29, 2014

Related U.S. Application Data

(60) Provisional application No. 61/730,256, filed on Nov. 27, 2012.

(51) Int. Cl.

| | |
|---|---|
| ***A41D 19/00*** | (2006.01) |
| ***A63B 71/14*** | (2006.01) |
| *A63B 102/14* | (2015.01) |

(52) U.S. Cl.

CPC ..... *A63B 71/143* (2013.01); *A63B 2102/14* (2015.10)

(58) Field of Classification Search

CPC .. A63B 71/141; A63B 71/143; A41D 13/015; A41D 13/081; A41D 13/08; Y10S 2/91; Y10S 2/907; A43D 19/015; A43D 19/01517; A43D 19/01523; A43D 19/02

USPC ..... 2/20, 16, 161.1–164, 169, 455; 112/475.1

See application file for complete search history.

(56) References Cited

U.S. PATENT DOCUMENTS

| | | | | |
|---|---|---|---|---|
| 1,377,338 A * | 5/1921 | Grinnell | A41D 19/02 | 2/169 |
| 2,538,837 A * | 1/1951 | Johnston | 2/169 | |
| 3,564,614 A * | 2/1971 | Getchell et al. | A41D 19/015 | 2/161.6 |
| 4,405,681 A * | 9/1983 | McEvoy | A47C 7/18 | 264/46.4 |
| 4,484,359 A * | 11/1984 | Tirinen | A41D 19/01523 | 2/161.1 |

(Continued)

OTHER PUBLICATIONS

Thumb, Sobotta's Atlas and Text-book of Human Anatomy, Dr. Johannes Sobotta, 1909. web. retrieved. Aug. 8, 2017. http://en.wikipedia.org/wiki/Thumb#/,edia/File:Sobo_1909_130.png.*

(Continued)

*Primary Examiner* — Clinton T Ostrup
*Assistant Examiner* — Jillian K Pierorazio
(74) *Attorney, Agent, or Firm* — Baker Donelson, PC; Royal W. Craig

(57) ABSTRACT

An embodiment of the present invention provides a protective sports glove having a novel combination of liner sections, breathable mesh sections, stretch joints, and shock absorbing cushions to provide maximum protection to the user's fingers, hands, wrists, and lower forearms while maintaining as much flexibility within the glove and tactile feel on both palmar and dorsal sides of the glove as possible. The pattern and construction employs strategically-placed stretch zones, strategic padding placement, and a variety of improved padding constructions all for more flex without compromising protection.

44 Claims, 6 Drawing Sheets

(56) References Cited

U.S. PATENT DOCUMENTS 4,815,147 A * 3/1989 Gazzano ..... A63B 71/143 2/161.1
5,511,243 A * 4/1996 Hall ..... A63B 71/143 2/16
5,511,248 A * 4/1996 Widdemer ..... A41D 19/01547 2/161.3
5,603,119 A * 2/1997 Rinehart ..... A41D 19/00 2/161.1
5,664,260 A * 9/1997 Weiser ..... A41D 19/02 2/159
6,085,354 A * 7/2000 Wilder ..... A63B 71/143 2/159
6,233,744 B1 * 5/2001 McDuff ..... A63B 71/143 2/16
6,550,069 B1 * 4/2003 Morrow ..... A63B 71/141 2/16
6,584,615 B1 * 7/2003 Wilder ..... A41D 19/01588 2/159
7,363,846 B1 * 4/2008 Dean ..... F41H 1/02 2/2.5
7,530,120 B2 * 5/2009 Morrow ..... A63B 71/143 2/161.1
D608,978 S * 2/2010 Votel ..... D2/617
7,784,110 B2 * 8/2010 Jourde ..... A41D 19/01588 2/161.1
7,836,521 B2 * 11/2010 Winningham ... A41D 19/01523 2/161.1
8,141,175 B2 * 3/2012 Winningham ... A41D 19/01523 2/161.1
8,201,272 B2 * 6/2012 Winningham ... A41D 19/01588 2/161.1
2003/0208833 A1 * 11/2003 Gold ..... A41D 19/02 2/161.1
2004/0261155 A1 * 12/2004 Agathos ..... A63B 71/143 2/161.1
2005/0114984 A1 * 6/2005 Morrow ..... A63B 71/143 2/161.1
2005/0251893 A1 * 11/2005 Hayden ..... A41D 19/01523 2/161.1
2006/0195967 A1 * 9/2006 Kohler ..... A41D 19/01523 2/161.1
2007/0277288 A1 * 12/2007 Sing et al. ..... 2/159
2008/0034469 A1 * 2/2008 Beland ..... A63B 71/143 2/161.1
2008/0263747 A1 * 10/2008 DeBlasis ..... A41F 1/06 2/161.1
2008/0313786 A1 * 12/2008 Saturnio ..... A41D 19/01588 2/16
2009/0019613 A1 * 1/2009 Carcaterra et al. ..... 2/16
2009/0044306 A1 * 2/2009 Lamson et al. ..... 2/16
2009/0077714 A1 * 3/2009 Baacke ..... 2/167
2010/0031603 A1 * 2/2010 Letts ..... B32B 27/40 52/745.06
2010/0281599 A1 * 11/2010 Fiegener ..... A41D 27/28 2/161.1
2011/0067165 A1 * 3/2011 Fream et al. ..... 2/161.1
2011/0126342 A1 * 6/2011 Bautista ..... A63B 71/143 2/161.1
2012/0030856 A1 * 2/2012 Bevier ..... 2/161.1
2012/0054937 A1 * 3/2012 Robaire ..... A63B 71/148 2/16
2012/0131716 A1 * 5/2012 Copeland ..... A63B 71/143 2/20
2014/0201880 A1 * 7/2014 Binge ..... A63B 71/141 2/20

OTHER PUBLICATIONS

Finger Bones I Phlanges, Human Anatomy, web. retrieved. Aug. 8, 2017. http://mananatomy.com/bodysystems/skeletal-system/finger-bones-phalanges.*

* cited by examiner

PROTECTIVE SPORTS GLOVE

CROSS-REFERENCE TO RELATED APPLICATION(S)

The present application derives priority from U.S. provisional application Ser. No. 61/730,256 filed 27 Nov. 2012.

BACKGROUND OF THE INVENTION

1. Field of the Invention

The present invention relates generally to lacrosse gloves and, more particularly, to a protective sports glove and padding for the same that provides improved flexibility, increased protection, and finer tactile feel.

2. Description of the Background

Protective sports gloves are commonly used and, indeed, are required to be used in many organized sports such as lacrosse, hockey, and other contact sports. Such gloves protect the wearer from impact of lacrosse sticks, hockey sticks, balls, pucks, skates, and other players.

Protective sports gloves include padding to protect the player's fingers, hands, wrists and lower forearms. Despite their protective function, such gloves must balance other design factors such as weight, feel and flexibility. For example, the handling of a lacrosse stick requires a player to hold and control a lacrosse stick handle in specific ways, with many different combinations of hand placement over the length of the handle. A lacrosse player constantly moves his hands along the handle in multiple positions.

In executing game skills, lacrosse players must be able to grip and control the lacrosse stick handle, e.g., "stick handling." Effective stick handling requires a player to constantly reposition his hands along the handle to control the head of the lacrosse stick. For effective stick handling, a lacrosse player needs to maintain utmost flexibility of the hand, a sure grip, and a precise tactile feel for the stick. However, the hand also needs protection and so players typically wear padded gloves to protect their hands and wrists. These gloves usually include foam padding or other protective padding covering the back of a wearer's hand, fingers, and thumb.

Some conventional sports gloves have pad segments (e.g., made of foam) that are covered with leather or synthetic leather and, in the breaks between the segments, are affixed to one another and to a liner material (also known as the scrim), such as a woven fabric. In these conventional gloves individual foam pads are typically sandwiched between two fabric layers and the layers are sewn together, and to the liner, between breaks in adjacent pads. However, this conventional construct is fairly rigid in design and compromises flexibility and tactile feel for protection. When such a protective athletic glove undergoes deformation due to normal use by a wearer, adjacent pads come into contact with each other and this arrests/resists further motion. In addition, the inflexibility of the fabric layers and liner resist stretching and further arrests/resists motion. In straining against these forces to maintain a grip on the lacrosse stick, a player tends to lose their tactile feel for the stick, and consequently their stick handling capability.

Even with gaps or breaks between the protective pads to allow for flexibility, there is a limitation to how far adjacent pads can move relative to each other and still maintain adequate protection of a player. What is needed is a protective sports glove and padding for the same that provides improved flexibility, increased protection, and finer tactile feel.

SUMMARY OF THE INVENTION

In one aspect, a protective glove includes a hand receiving portion that includes a plurality of finger portions, a thumb portion, a metacarpal portion and a wrist portion. The hand receiving portion includes a dorsal side and a palm side. The dorsal side of the hand receiving portion includes an inner liner and a plurality of protective elements attached to an exterior surface of the inner liner. The palmar side of the hand receiving portion includes an inner liner. The invention employs a novel combination of liner sections, stretch joints, and shock absorbing cushions to provide maximum protection to the user's fingers, hands, wrists, and lower forearms while maintaining as much flexibility within the glove and tactile feel on both palmar and dorsal sides of the glove as possible. The pattern and construction employs strategically-placed stretch zones, strategic padding placement, and a variety of improved padding constructions all increasing flexibility where needed without compromising protection. Flexibility is desired by the wearer so as to impart freedom of movement to the fingers, hand, wrists and lower forearms needed to maintain an accurate tactile feel for the lacrosse, hockey or other sports stick during a match, while protection is required to reduce injury.

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Lacrosse, hockey and other stick-wielding sports players need to be able to flex in all directions freely in order to grip their stick and engage in necessary wrist action while still maintaining an acceptable level of protection. However, as discussed above, conventional glove design limits the amount of flex that is available to a player when they are manipulating a lacrosse or hockey stick. Specifically, conventional protective sports gloves have limited flexion and extension as well as difficult radial and ulnar deviation, and poor dorsiflexion as well. Described herein is a protective sports glove and padding for the same that maximizes flexibility without compromising protection, thereby affording more accurate tactile feel for better stick handling.

An embodiment of the present invention provides a protective sports glove closely fitted to the hand using a particular pattern of different material sections including liner sections (formed of leather, synthetic woven or knit materials or the like), breathable mesh sections, stretch joints formed of elastic Lycra™ (or other stretch nylon, polyester, Dacron™, neoprene or suitable material), and shock absorbing cushions that provide general protection against strikes and blows to the player's hand. The shock absorbing cushions are attached to the glove only over certain defined areas and sewn thereto in a particular pattern so as to cover dorsal portions of both hand and wrist.

Figure 1:
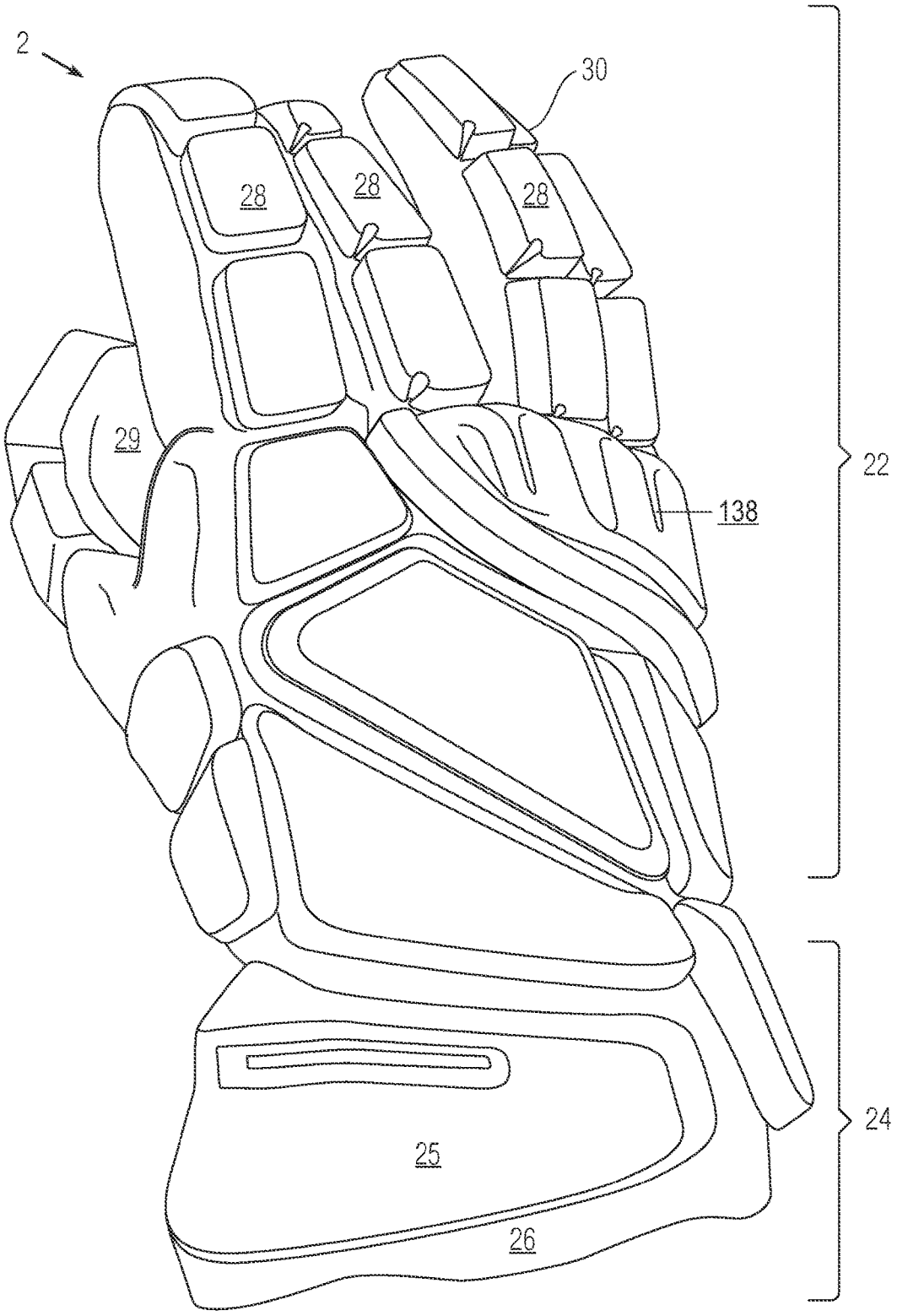
FIG. 1 is a perspective illustration of the dorsal side of a protective sports glove 2 in accordance with an embodiment of the present invention.
Figure 2:
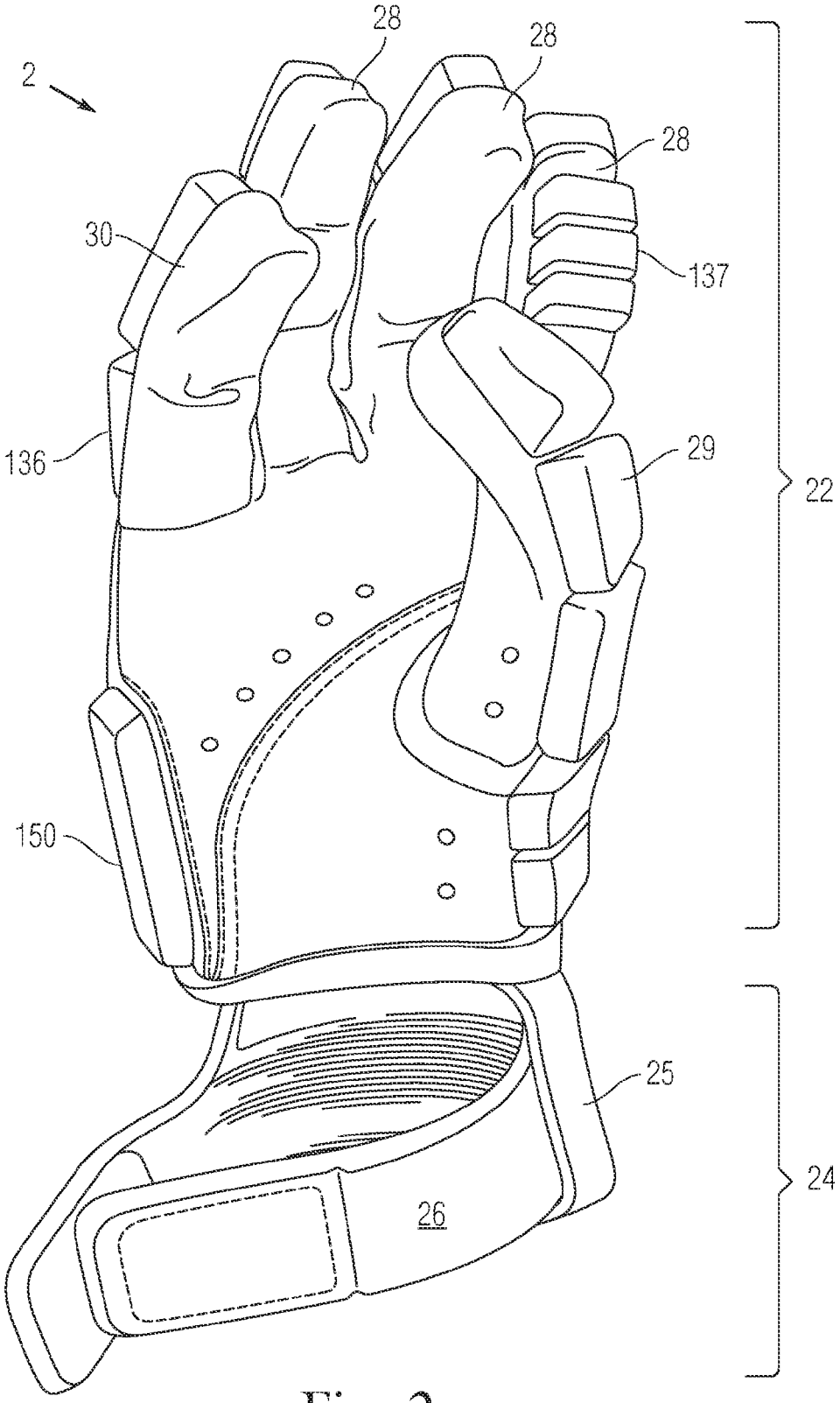
FIG. 2 is a perspective illustration of the palmar side of the protective sports glove 2 of FIG. 1.

With reference to FIGS. 1-2, the protective athletic glove 2 includes a hand receiving portion 22 covering all five digits and the carpometacarpal joints of the hand and extending down approximately to the wrist crease, and a lower wrist/forearm portion 24 extending down from the wrist crease to a distance from one to three inches. Glove 2 inclusive of both hand receiving portion 22 and lower wrist/forearm portion 24 has both a palmar side (FIG. 2) and a dorsal side (FIG. 1). The junction of the hand receiving portion 22 and lower wrist/forearm portion 24 is partially encircled by an off-centered, irregularly-shaped cuff inclusive of a wrist cushion 25 that partially surrounds the dorsal side and an adjustable collar 26 that extends below the hand receiving portion 22 and which may be tightened across the palmar side by hook-and-loop pads. The hand receiving portion 22 further includes a first (little finger) receiving portion 30, second (ring), third (middle) and fourth (index) finger receiving portions 28, and a fifth (thumb) receiving portion 29.

The hand receiving portion 22 inclusive of finger and thumb receiving portions 28, 29, 30, as well as lower wrist/forearm portion 24 are formed with layers of liner, breathable mesh sections, stretch joints, and shock absorbing cushions. The particular pattern of liner sections, breathable mesh sections, stretch joints, and shock absorbing cushions is designed to provide maximum protection to the user's fingers, hands, wrists, and lower forearms while maintaining as much flexibility within the glove and tactile feel on the palmar side of glove 2 as possible. Flexibility is desired by the wearer so as to impart freedom of movement to the fingers, hand, wrists and lower forearms needed to properly participate in lacrosse, hockey or other sports matches while protection is required to reduce injury.

Figures 3, 4, 5:
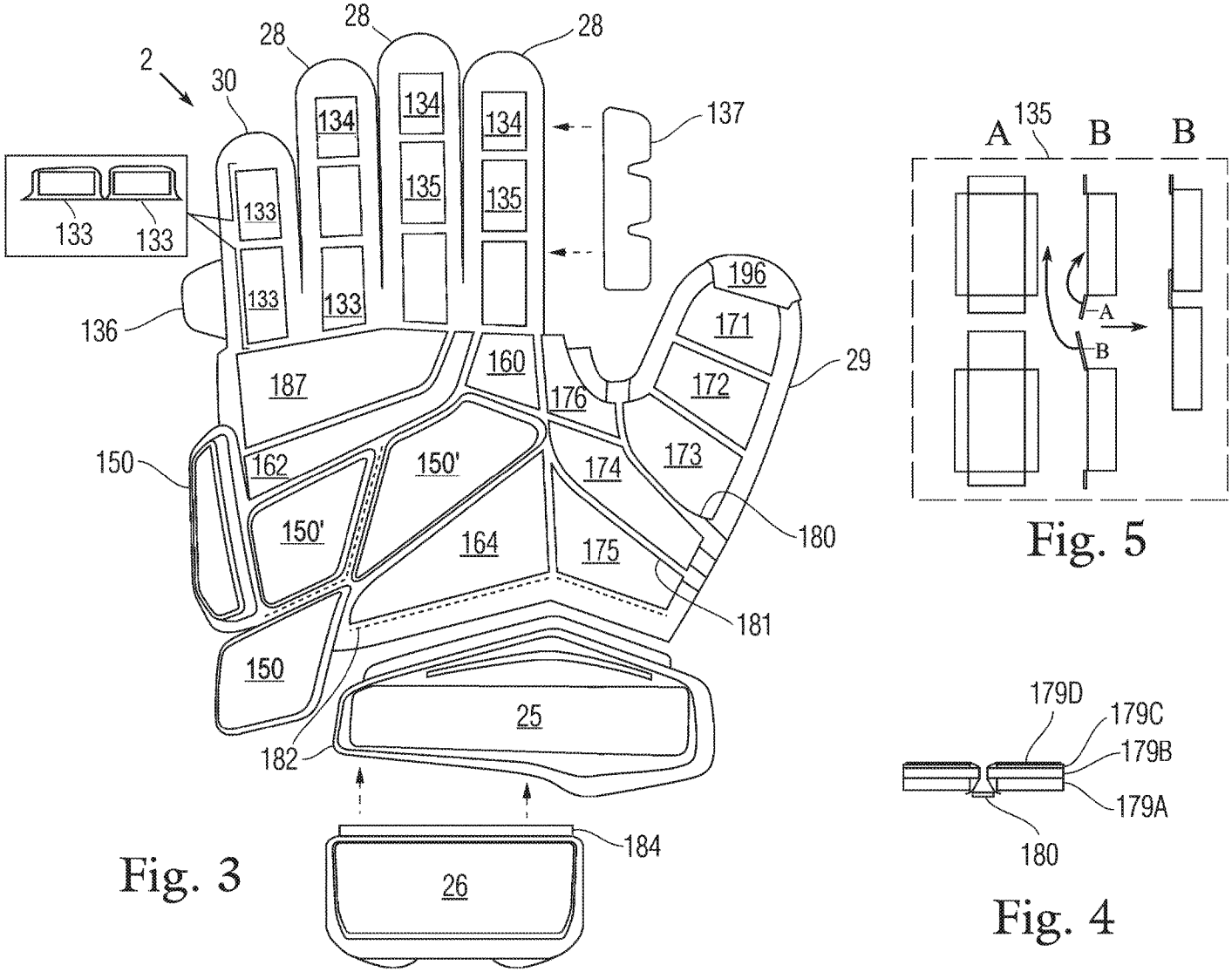
FIG. 3 is an exploded pattern-cut illustration of the dorsal side of the protective sports glove 2 as in FIGS. 1-2.
FIG. 4 is an enlarged illustration of an exemplary stretch zone 180.
FIG. 5 is an enlarged illustration of an exemplary overlapped tab cushion 135.

FIGS. 3-5 collectively illustrate this pattern on the dorsal side of glove 2. Each of the finger receiving portions 28, 30 and thumb receiving portion 29 are fully encapsulated in a liner section of fabric and all bear a plurality of shock absorbing cushions on the dorsal side sewn to the liner section beneath. All shock absorbing cushions are generally made of one or more blocks of micro-cellular foam, preferably open cell, urethane foam (e.g., Poron™, PVC nitrile foam, or another suitable impact-absorbing closed cell foam material). The shock absorbing blocks are encased in a fabric material, such as Nylon™ or other suitable fabric material. The various cushions on the dorsal side are separated from one another by breaks that provide flexibility between the cushions when a wearer's hand is flexed. As described below, this particular array of shock absorbing cushions with their array of different seam constructions optimizes flexibility.

Specifically, the small finger receiving portion 30 bears two or more shock absorbing cushions 133 preferably comprising multiple discrete foam blocks encased in fabric material and sewn peripherally around and between the cushions to the underlying liner, thereby forming a single break there between, as seen in the inset (left). The shock absorbing cushions 133 extend along a majority of the length of the dorsal side of small finger receiving portion 30. The second (ring) finger receiving portion 28 also bears multiple shock absorbing cushions 133 as above, in this case extending approximately along the first and second phalanges.

The small finger receiving portion 30 may (optionally) bear a wart pad 136 comprising a covered or uncovered single foam block or other protective element protruding sidelong from the third phalange and sewn peripherally to the underlying liner section. Wart pad 136 provides protection from sideward impact to the small finger.

Similarly, the index finger receiving portion 28 may (optionally) have a wart pad 137 comprising a covered or uncovered single foam block or other protective element protruding sidelong along its length and sewn peripherally to the underlying liner section. Wart pad 137 provides protection from sideward impact to the index finger.

In addition, the second (ring) finger receiving portion 28 bears one or more shock absorbing cushions 134 comprising one or more foam block(s) or other protective element(s) encased in fabric material and sewn peripherally around the block to the underlying liner, thereby forming an "island" cushion 134. The island cushion 134 extends approximately along the third phalange of the dorsal side of second (ring) finger receiving portion 28.

The third (middle) and fourth (index) finger receiving portions 28 may also bear an island cushion 134 extending approximately along the third phalanges of the dorsal side of the third and fourth finger receiving portions 28.

In addition, the third and fourth finger receiving portions 28 also each bear multiple shock absorbing cushions 135 comprising at least two discrete foam blocks or other protective element encased in fabric material and joined by a unique "overlapped tab" construction to increase flexibility.

FIG. 5 illustrates the overlapped tab double shock absorbing cushions 135 as per above, with top view at (A) and side views at (B).

The overlapped tab cushions 135 comprising two (or more) discrete foam blocks or other protective element covered by two discrete sections of fabric material each cut substantially in a cross-shape to define four protruding tabs. The bottoms of the foam blocks are not covered. The three outlying tabs of each block are sewn to the underlying liner as shown. However, the two adjoining tabs (between blocks) are overlapped. Specifically, one adjoining tab (tab A) is tucked under its block, and the other tab (tab B) is tucked under tab A. Note that the tucked tab B is preferably longer so as not to dislodge. These adjoining tabs (A and B) are not sewn, but remain free to shift as the finger is flexed. This novel overlapped tab cushion 135 increases flexibility compared to tabs that are sewn to an underlying liner and constrict movement of the blocks when stretched during gripping action. Moreover, the overlapped tab cushions 135 are optionally extended approximately along the second and first phalanges of the dorsal side of the third and fourth mid-finger receiving portions 28, but can be anywhere along the dorsal side of finger receiving portions 28 to increase flexibility where needed to improve tactile feel for a lacrosse or hockey stick.

Figures 6A, 6B, 6C:
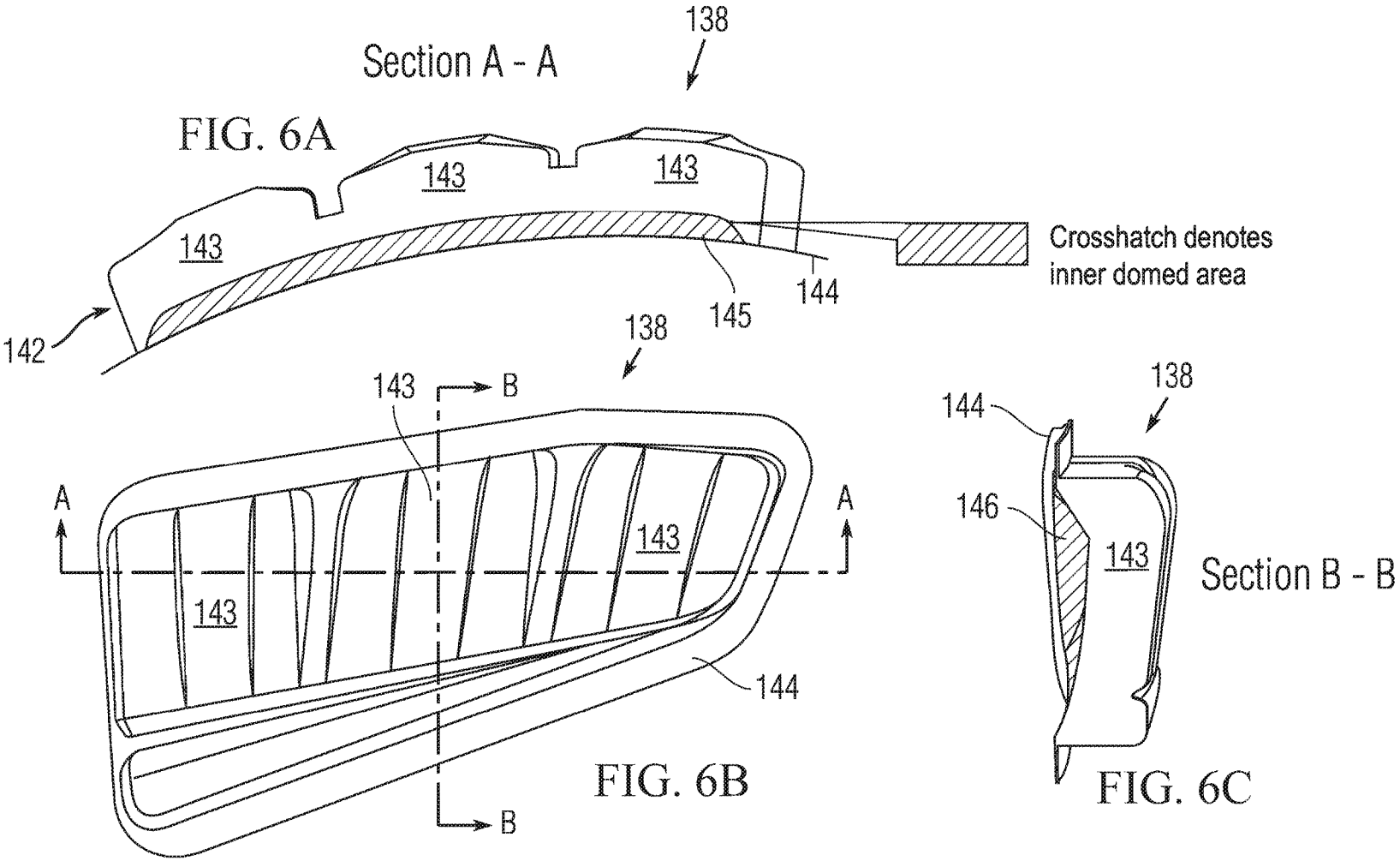
FIG. 6 is a composite view of the triple wart pad 138 with side view at (A), top view at (B), and end cross-section at (C).

Referring back to FIG. 3, an elongate strip of thin padding 162 runs substantially along the heart line of the hand to the junction of the third (middle) and fourth (index) finger-receiving portions 28. Above the padding 162 is an area 187 for positioning a triple wart pad 138, area 187 being below the first through third finger-receiving portions 30, 28, overlapping the proximal side of the glove 2, and running adjacent to the padding 162. In one preferred embodiment, triple wart pad 138 comprises a dual-density compression molded elastomeric foam member which may be covered or uncovered, and which generally protrudes from a user's knuckles. The dual-density foam of wart pad 138 includes a thin-gauge, high-density upper layer and high-performance, low-density foam pad segment(s) compression molded onto the upper layer for flexibility. The dual-density molding of wart pad 138 and other dual-density foam blocks (described below) may be accomplished by injection molding, which process comprises the steps of sequentially injecting one of the two different foam formulations into a mold, curing, and then injecting the second foam formulation. Typically, a thin-gauge, high-density upper layer is injected first to form a bolster, followed by one or more thicker gauge lower-density foam pad(s) co-molded onto the upper layer. It would be understood by one having ordinary skill in the art that the dual-density molding of wart pad 138 may also be accomplished through other available means of molding foam, such as by compression molding or co-molding. It would also be understood by one having ordinary skill in the art that the dual-density foam blocks described herein, including wart pad 138, may be comprised of two (2), three (3), or four (4) layers of foam with varying densities using any of the foam molding processes described above. It would also be understood by a person having ordinary skill in the art that one or more of the layers within the herein-described foam blocks may be comprised of a material other than foam. The number of layers within the herein-described foam blocks, their composition and their densities, including the order of the different densities as they are stacked from lowest to highest within the foam pad, may be varied for each of the herein-described foam pads to accomplish desired performance characteristics. The foam pads are spaced by interstitial margins, and the bolster is slightly larger than the foam pad(s) to leave a surrounding margin. This way, both surrounding and/or interstitial bolster margins may be sewn to the liner fabric around the foam pads. In another preferred embodiment, the surrounding margin used for stitching is comprised of not just the bolster (or highest-density layer) but all of the layers comprising the foam pad which layers are compressed or molded to a minimal thickness near the base of the pad. One having ordinary skill in the art would comprehend that the surrounding margin may be comprised of any or all of the layers comprising the foam block and is not necessarily the highest-density layer therein as set forth above. FIG. 6 is a composite view of the triple wart pad 138 with side view at (A), top view at (B), and end cross-section at (C). The triple wart pad 138 may be a unitary molded quadrilateral open-bottom enclosure 142 formed in an elongate concave configuration with pronounced concavities 143 defining each of the (here three) warts 143. Each wart 143 may be formed with ornamental surface features for aesthetics. The entire wart pad 138 may be surrounded by a peripheral flange 144 that provides a frame for stability and also allows stitching through the flange 144 such that the triple wart pad 138 can be sewn to the underlying scrim (liner material) adjacent at least three (3) finger receiving portions 28 and generally above the user's knuckles. One having ordinary skill in the art would understand that the flange may be comprised of any or all of the layers that make up the foam pad, the order of which may be changed depending on desired performance characteristics. In one preferred embodiment, the flange is comprised of every layer within the foam pad, where said layers are compressed or molded into a minimal thickness near the base of the pad. It would be understood by one having ordinary skill in the art that the flange and/or surrounding margin may be attached or adhered to the underlying scrim (liner material) using any suitable method, not necessarily by stitching. The inherent elasticity of the material and the bubble-like concave configuration of the spaced warts 143 provide excellent shock absorption capabilities against direct impact. In addition, the bubble-like configuration greatly increases the flexibility of the wart pad 138 along its length and allows for easier curling of the knuckles as they naturally raise into the concave configuration. Similarly, at least one and preferably both endwalls 146 are likewise arched, disjoined from the flange 144 along a majority of its length and connected thereto only proximate the corners. This increases the flexibility of the wart pad 138 along its width. The underside of the triple wart pad 138 proximate to its connection with the underlying scrim/liner may further have a concave inner domed shape 145 such that the portion of the triple wart pad 138 that is not attached to the flange 144 is curved so as to not directly contact the flange 144 when the hand is in a resting position. This configuration further increases the flexibility of the knuckle portion of the glove.

In a further embodiment, the underlying scrim (liner material) to which triple wart pad 138 is sewn contains a slit or opening (not shown) along a portion of its length and beneath triple wart pad 138, thereby further increasing the flexibility of the knuckle portion of the glove during flexing.

In a further embodiment, triple wart pad 138 is attached by sewing or other means to a separate stretch fabric material (not shown), which itself is sewn or otherwise attached to the underlying scrim, enabling the triple wart pad 138 to float independently from the rest of the glove padding during flexing and thereby further increasing the flexibility of the knuckle portion of the glove.

Referring back to FIG. 3, protective pad 150 is sewn to the dorsal side of the lower wrist/forearm portion 24 of the glove 2. Protective pad 150 is a unitary molded component preferably formed of dual density foam including a thin-gauge, high-density upper layer sewn to the underlying scrim/liner and high-performance, low-density foam pad segments co-molded onto the upper layer as described above. It will be understood that protective pad 150, like triple wart pad 138 and any or all other molded foam parts on the glove, may be formed using the variations described above with respect to the triple wart pad 138 as to method of formation, number, density and composition of layers, order of layer densities within the pad, composition of the surrounding margin and/or flange, method of attachment of the pad to the glove, and so on. The interstitial areas of the lower layer between the laminated pad segments form hinges for flexibility. In the illustrated embodiment protective pad 150 is defined by a plurality of low-density (LD) pad segments arranged in a T-configuration, the pad segments being separated by thin interstitial margins or breaks. Two LD pad segments define the top of the T (150), and two define the stem (150'). The top of the T (150) drapes over the outside of the hand at the metacarpals to provide sidelong impact protection. The stem (150') runs at an angle almost to the fourth (index) finger-receiving portion 28. The stem (150') is separated from the fourth finger-receiving portion 28 by a small quadrilateral section of thin padding 160. The elongate strip of thin heart line padding 162 runs above the T-stem (150') following its angle and continuing adjacent padding 160. A substantially triangular section of thin padding 164 runs below the T-stem (150'). Protective pad 150 is flanked by thin padding sections 160, 162, 164 and effectively covers the entire back of the hand. The preferred layered construction of thin padding sections 160, 162, 164 is described below, and maximizes protection for the back of the hand.

Thumb receiving portion 29 is formed separately from the rest of the glove, and is attached to the glove by a circumscribed stretch zone 180 made of Lycra™ or other suitable stretch material, as described below. The dorsal side of the thumb-receiving portion 29 contains six (6) plates of thin padding 171-176 as shown, all sewn to an underlying scrim/liner, and all separated by breaks to accommodate flex points at each phalangeal and metacarpal joint when a player wearing glove 2 wraps his hand around a stick during play.

As seen in FIG. 4, each piece/plate of thin padding 160-164 and 171-176 is generally formed by two thin sheets of foam 179A, 179B and one thin-gauge piece of polyethylene (PE) board 179C, all cut to the desired shape and encased in vinyl fabric 179D. The sheets of foam range in durometer from highest (atop) at 179C to lowest (at bottom) 179A in the stack. Each plate of padding 160-164 and 171-176 is sewn to the underlying liner, and all are separated by breaks located to accommodate flex points at each phalangeal and metacarpal joint when a player wearing glove 2 wraps his hand around a stick during play.

The lower wrist/forearm portion 24 is defined by a cuff attached below the hand receiving portion 22, the cuff comprising a wrist cushion 25 that partially surrounds the dorsal side and an adjustable collar 26 that extends below the wrist cushion 25 and which may be tightened across the palmar side by hook-and-loop pads. The cuff is eccentric, being both off-centered on the dorsal side, and formed with an irregular shape. Both wrist cushion 25 and adjustable collar 26 are formed of dual-density compression molded foam as described above, including a thin-gauge, high-density upper layer sewn to the underlying scrim/liner and high-performance, low-density foam pad co-molded onto the upper layer for increased flexibility. It will be understood that the wrist cushion 25, like triple wart pad 138 and any or all other molded foam parts on the glove, may be formed using the variations described above with respect to the triple wart pad 138 as to method of formation, number, density and composition of layers, order of layer densities within the pad, composition of the surrounding margin and/or flange, method of attachment of the pad to the glove, and so on.

The wrist cushion 25 is attached to the dorsal side of the glove by a first gusset 182. Gusset 182 is an inset strip of material such as Lycra™ or other stretch material which provides a limited degree of expansion. In another preferred embodiment, wrist cushion 25 may be stitched directly to the dorsal side of the glove without the use of a gusset. Similarly, the adjustable collar 26 is attached to the wrist cushion 25 at a second gusset 184, e.g., joined by Lycra™ or other stretch material, such as elastic. Collar 26 is tightened upon itself and fastened by hook-and-loop pads (obscured in FIG. 5), or alternatively a tether across the palmar side. Wrist cushion 25 may also have a channel or opening along a portion of its length, adding flexibility and airflow for cooling. The stretch material at second gusset 184 is of a particular size and shape (e.g. an oblong annulus), so that it performs as intended when a player's wrist bends forward during play. That is, when the collar 26 is fastened tight and a player's wrist bends or flexes forward, the stretch material at second gusset 184 does not inhibit a player's movement and simultaneously allows the adjustable collar 26 to remain in place to cover the player's wrist. Any other design, such as a rectangular shaped stretch material, would not perform in this manner, possibly leaving a player's wrist exposed. The wrist cushion 25 and adjustable collar 26 provide a degree of caterpillar-like flexibility for a wearer during play. Moreover, the wrist cushion 25 is joined to the finger-receiving portion 22 at an angled joint as illustrated, and a first gusset 182 is provided at this angled joint as described above. As a result of the angled joint and stretch zone the more traditional (prior art) and cumbersome "cuff roll" can be eliminated. This provides a more streamlined, unrestricted glove.

Each gusset 182, 184 is formed by attaching two opposing (caterpillar-like) segments using Lycra™ or other stretch-fabric. More specifically, the second gusset 184 is formed by attaching a strip of Lycra™ or elastic stretch-fabric underneath the edges of wrist cushion 25 to the adjoining liner/scrim. Similarly, the first gusset 182 is formed by attaching a strip of Lycra™ stretch-fabric underneath the edges of adjoining collar 26 and wrist cushion 25.

In addition to gussets 182, 184, the glove 2 is preferably equipped with two stretch zones 180, 181 in the thumb-metacarpal of the hand.

The upper stretch zone 180, and optional stretch zone 181 are depicted in FIG. 4. Each of the bordering plates of padding 171-176 are modified so that the middle sheet 179B is slightly larger than upper or lower sheets 179A, 179C such that it protrudes outward further. In effect, once encased in vinyl fabric 179D, this rounds the facing edges of each of the bordering plates of padding 171-176 and provides an abutting joint there between to maintain coverage. At least the bordering plates of padding 173, 174 and 176 are modified in this "jointed" fashion in order to facilitate the upper stretch zone 180, and all plates 160-176 may be jointed as such. In addition, jointed plates of padding 173, 174 and 176 have a strip of Lycra™ stretch-fabric sewn beneath them (see FIG. 4). The combination of jointed plates of padding 173, 174 and 176 in a stretch zone 180 configuration substantially closes the break between the bordering plates of padding 173, 174 and 176 (since the rounded edges of plates 173, 174, 176 overhang the break closing it off). The friction reduction between jointed plates 173, 174, 176 as they pivot provides increased flexibility and improved tactile feel.

Figures 7, 8, 9:
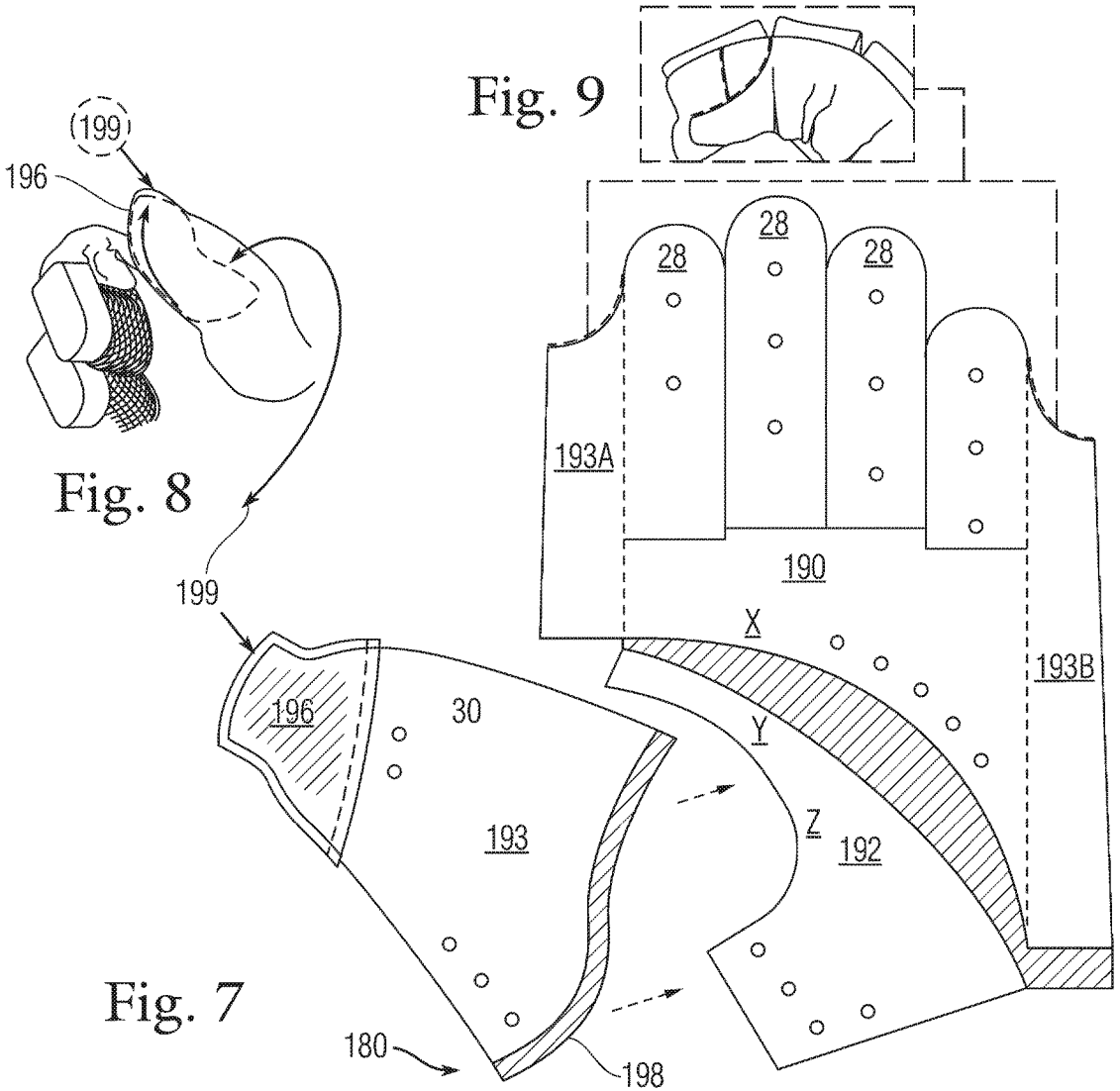
FIG. 7 is an exploded pattern-cut illustration of the palmar side of the protective sports glove 2 as in FIGS. 1-2, separate thumb pattern-cut and stretch zone between the thumb and palmar side.
FIG. 8 is an enlarged illustration of the wrap-around thumb pad 199 furled over the tip of the thumb-receiving portion 30.
FIG. 9 is an enlarged illustration of a transition gusset between the outside portion of the little finger and index finger receiving portions and the palmar side.
Figure 10:
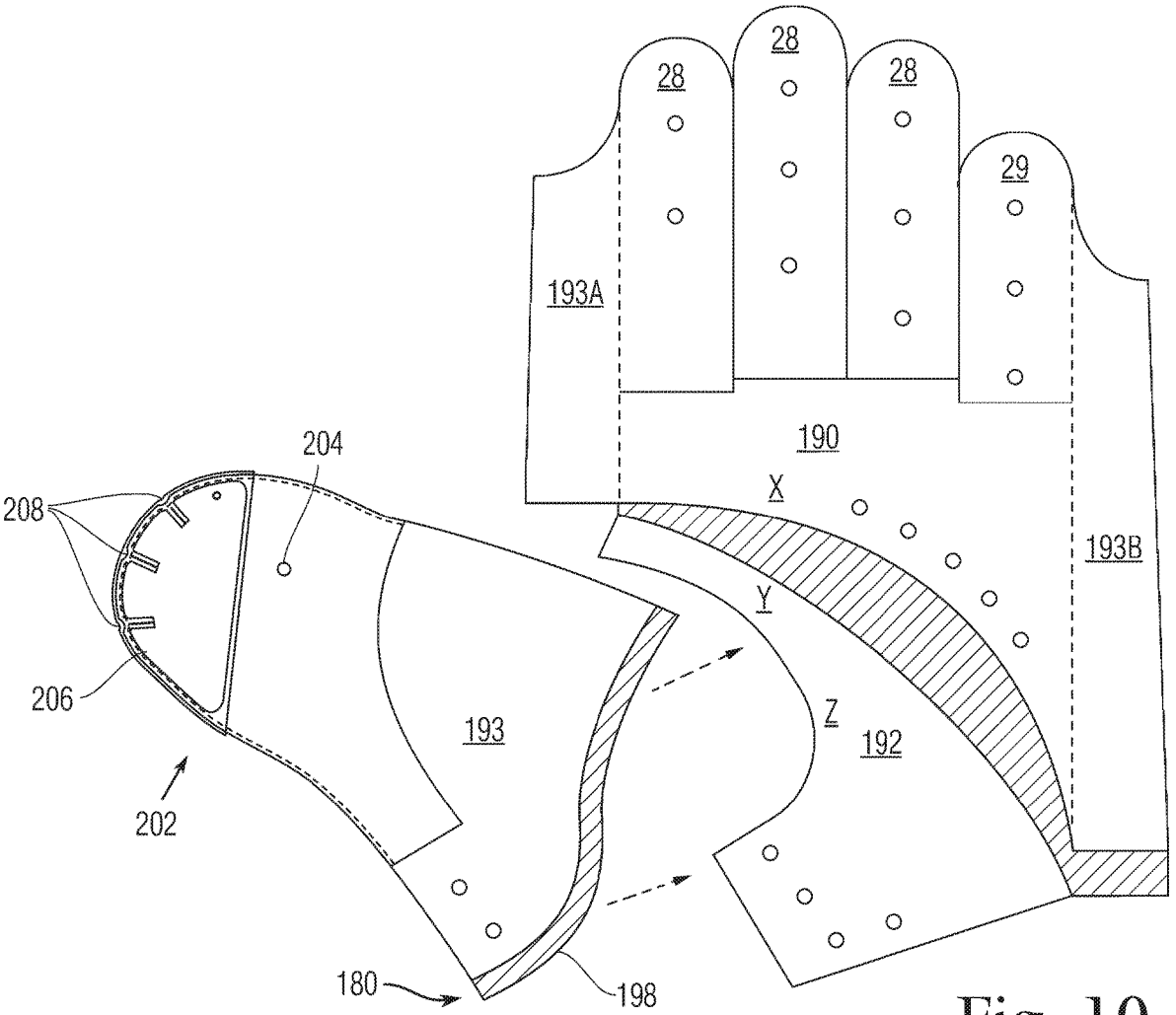
FIG. 10 is a front view illustrating an alternative thumb pad sewn to the tip of the thumb portion.

FIGS. 7-9 collectively illustrate the pattern on the palmar side of glove 2, which generally has no padding except for a thumb pad 196 to be described, but instead comprises the bare liner (leather or similar synthetic material). Since the liner is inherently flexible, the user can easily maintain a grip. However, the ability to maintain an accurate tactile feel with a lacrosse and/or hockey stick requires absolute minimization of pressure points and friction, and this is herein accomplished with a particular cut pattern and by wrapping stretch zone 180 around the thumb. The cut pattern for the palmar section of liner generally comprises three discrete sections: a finger-receiving section 190; a palm section 192, and a thumb section 193. The palm section 192 is cut from the liner to define the palmar side of four of the finger receiving portions 28, 29 but not thumb 30. On both sides of the finger-receiving section 190 a protruding margin is formed 193A, 193B. The margin 193A protrudes outward beginning at the distal phalangeal joint of the index finger-receiving portion 28 and increasingly protrudes outward ending at the metacarpophalangeal joint. The margin 193B protrudes outward beginning at the distal phalangeal joint of the little finger-receiving portion 29 and increasingly protrudes outward ending at the base of the little finger metacarpals bone. Thus, the margin 193B runs approximately twice the length of the margin 193A. These margins 193A, 193B in the cut of the finger-receiving section 190 are wrapped around and sewn beneath the dorsal liner to form a tapering-wrapped-palm construction in which the interior volume of the glove 2 expands downward along the palm, providing for an improved fit, as shown in FIG. 9. The finger-receiving section 190 is further cut along a crescent (X) extending from the bottom of margin 193A to the bottom of margin 193B, crescent (X) generally following the palmar crease of the hand.

Where the palm section 192 adjoins the finger-receiving section 190 it is likewise cut along a crescent (Y) of slightly larger radius than crescent (X). Upon construction, the edges along the two crescents (X, Y) are aligned and the palm section 192 is sewn to the finger-receiving section 190 along the two crescents (X, Y), which forces a natural contour in the palm section 192 that properly conforms to a clenched thumb. Note also that the finger receiving portions and the inside of crescent (X) are defined by patterns of perforations cut from the finger-receiving section 190 to improve ventilation. The opposing side of the palm section 192 is cut with a U-shaped arch (Z) to conform to and provide clearance at the base of the thumb. The thumb portion 193 is cut substantially in a half-dome shape to provide a partial wrap around the thumb. In accordance with the present embodiments, the base of the thumb portion 193 is cut as a shallow S-shape and a conforming strip 198 of stretch fabric such as Lycra™ is sewn thereto. Alternatively, the thumb portion 193 is cut with just a curve as shown in FIG. 10. Strip 198 is then sewn beneath the U-shaped arch (Z) in palm section 192 to provide the circumscribing stretch zone 180 at the base of the thumb.

A novel thumb pad 196 is sewn to the tip of the thumb portion 193. Thumb pad 196 comprises a cut section of thin foam sheet, such as, for example, a 2.5 mm thick closed cell foam sheet. The sheet is cut in a partial dome-shape to conform to the tip of the thumb, but the tip of the dome is extended along a rectangular tab which provides a short wrap-around extension 199. As seen in FIG. 8, this wrap-around extension 199 is furled directly over the tip of the thumb-receiving portion 30 and is sewn overtop to prove a continuous foam pad covering over the distal tip of the thumb. This guards against direct impact to the sensitive tip of the thumb without detracting tactile feel at the pad of the thumb.

FIG. 10 is a front view illustrating an alternative thumb pad 202 sewn to the tip of the thumb portion 193 for providing even more padding against direct impact to the sensitive tip of the thumb. Thumb pad 202 includes a gusset 204 formed as an extra layer covering the palmar side of the thumb, and an external thumb guard including a crescent-shaped section of foam (obscured) underlying a substantially crescent-shaped section of vinyl fabric 206. The foam is a cut section of thin foam sheet, such as, for example, a 2.5 mm thick closed cell foam sheet. The foam is cut in a half-moon or crescent shape to conform to the distal tip of the thumb. As seen in FIG. 10, the arched perimeter of the crescent-section 206 is defined by a plurality of radial notches 208. Notches 208 provide a clearance space between gusset 204 and crescent section 206 for accommodating the foam layer there beneath. In addition radial notches 208 allow the thumb pad 202 to conform better to the cured tip of the thumb. For example where the dorsal section of fabric joins the palmar section of fabric at the tip of the thumb the seam is typically pleated around the tip to accommodate the arch. Radial notches 208 define fingers of crescent-section 206 that can be sewn around the pleating, thereby providing a stronger junction of thumb pad 202. The thumb pad 202 guards against direct impact to the sensitive tip of the thumb without detracting tactile feel at the pad of the thumb.

It should now be apparent that the above-described protective sports glove 2 allows a user to flex the hand in all directions freely, to grip a lacrosse, hockey or other type of sports stick, and to maintain accurate tactile feel at every necessary wrist inclination, all while maintaining an suitable level of protection. The glove 2 allows freer flexion and extension, as well as radial and ulnar deviation, and dorsiflexion.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A protective sports glove comprising:

a hand portion configured for covering a user's hand inclusive of fingers, thumb and carpometacarpal joints and configured for extending down approximately to a wrist crease of said user's hand, said hand portion including a palmar side, a dorsal side, a little finger receiving portion, ring finger receiving portion, middle finger receiving portion, index finger receiving portion, and thumb receiving portion, each of the little finger receiving portion, ring finger receiving portion, middle finger receiving portion, index finger receiving portion, and thumb receiving portion being encapsulated in a liner section of fabric, the liner section of fabric at said thumb receiving portion being attached to said hand portion by a circumscribing section of stretch material;

a lower wrist portion attached to said hand portion and configured for extending down from said wrist crease;

a cuff portion partially encircling the lower wrist portion;

a plurality of shock absorbing foam cushions attached to said hand portion, inclusive of at least two adjacent foam blocks each covered by a section of fabric material, each said section of fabric material being cut substantially in a cross-shape to define four protruding tabs, and three of the tabs of each said section of fabric material being sewn to said liner section of fabric and one tab of each of said section of fabric material being tucked but not sewn under the adjacent foam block.

2. The protective sports glove according to claim 1, wherein said plurality of shock absorbing foam cushions attached to said hand portion includes at least two adjacent discrete foam blocks both encased in fabric material and sewn peripherally around and between said plurality of shock absorbing cushions to the liner section of fabric underlying one of said finger receiving portions.

3. The protective sports glove according to claim 1, wherein said plurality of shock absorbing foam cushions includes a foam pad sewn to said liner section of fabric and protruding sidelong lengthwise along said index finger portion for protection from sideward impact.

4. The protective sports glove according to claim 1, wherein said plurality of shock absorbing foam cushions includes a foam pad sewn to said liner section of fabric and protruding sidelong lengthwise along said little finger portion for protection from sideward impact.

5. The protective sports glove according to claim 1, wherein said plurality of shock absorbing foam cushions includes a foam pad sewn to said liner section of fabric and configured to extend along a third phalange of said user's hand on said dorsal side of the middle finger receiving portion.

6. The protective sports glove according to claim 5, wherein said plurality of shock absorbing foam cushions includes a foam pad sewn to said liner section of fabric and configured to extend along a third phalange of said user's hand on said dorsal side of the index finger receiving portion.

7. The protective sports glove according to claim 1, wherein said plurality of shock absorbing foam cushions includes a foam pad sewn to said liner section of fabric and configured to extend along a third phalange of said user's hand on said dorsal side of the index finger receiving portion.

8. The protective spoon glove according to claim 1, further comprising an elongate strip of thin padding configured to extend substantially along a heart line of said user's hand approximately to a junction of said middle finger receiving portion and said index finger receiving portion.

9. A protective sports glove comprising:

a hand portion configured for covering a user's hand inclusive of fingers thumb and carpometacarpal joints and configured for extending down approximately to a wrist crease of said user's hand, said hand portion including a palmar side, a dorsal side, a little finger receiving portion, ring finger receiving portion, middle finger receiving portion, index finger receiving portion, and thumb receiving portion, each of the little finger receiving portion, ring finger receiving portion, middle finger receiving portion, index finger receiving portion, and thumb receiving portion being encapsulated in a liner section of fabric, the liner section of fabric at said thumb receiving portion being attached to said hand portion by a circumscribing section of stretch material;

a lower wrist portion attached to said hand portion and configured for extending down from said wrist crease, wherein said lower wrist portion comprises a protective pad formed of dual density molded foam including a thin-gauge, high-density upper layer sewn to said liner section of fabric and at least one low-density foam pad co-molded onto the upper layer;

a cuff portion partially encircling the lower wrist portion; and a plurality of shock absorbing foam cushions attached to said hand portion, at least one of said plurality of shock absorbing foam cushions further comprising a triple wart pad consisting of a unitary molded foam pad attached to said liner section of fabric on the dorsal side of said hand receiving portion beneath said finger receiving portions and configured to traverse a plurality of said finger receiving portions, said triple wart pad comprising a elongate quadrilateral having a plurality of pronounced concavities defining discrete blocks.

10. The protective sports glove according to claim 9, wherein said plurality of shock absorbing foam cushions includes at least one dual-durometer molded foam block.

11. The protective sports glove according to claim 10, wherein said plurality of shock absorbing foam cushions includes at least two dual-durometer molded foam blocks.

12. The protectitie sports glove according to claim 9, wherein said triple wart pad comprises a dual-durometer molded foam block.

13. The protective sports glove according to claim 9, wherein said triple wart pad comprises a unitary molded concave quadrilateral shape.

14. The protective sports glove according to claim 9, wherein said triple wart pad comprises a unitary molded concave shape surrounded by a peripheral flange that is sewn to said liner section of fabric.

15. The protective sports glove according to claim 9, wherein said triple wart pad comprises a unitary molded shape defined by a plurality of concave bubbles.

16. The protective sports glove according to claim 9, wherein said fabric liner underlying said triple wart pad comprises an opening.

17. The protective sports glove according to claim 9, wherein said plurality of shock absorbing foam cushions includes one or more cushions extending along a major a length of the little finger receiving portion on said dorsal side.

18. The protective sports glove according to claim 9, wherein said plurality of shock absorbing foam cushions includes a wart pad on said little finger configured to be positioned proximate a third phalange of said user's hand, sewn peripherally to said liner section of fabric.

19. The protective sports glove according to claim 9, wherein said plurality of shock absorbing foam cushions includes a plurality of foam cushions on said ring finger receiving portion configured to extend proximate and along a first phalange and second phalange of said user's hand.

20. The protective sports glove according to claim 9, wherein said plurality of shock absorbing foam cushions includes a wart pad on said index finger configured to be positioned proximate a third phalange of said user's hand, sewn peripherally to said liner section of fabric.

21. The protective sports glove according to claim 9, wherein said cuff portion comprises a wrist cushion partially surrounding the dorsal side of said hand portion and an adjustable collar extending below the hand portion, said collar comprising mating hook-and-loop pads.

22. A protective sports glove comprising:

a hand portion configured for covering a user's hand inclusive of fingers, thumb and carpometacarpal joints and extending down approximately to a wrist crease of said users hand, said hand portion including a palmar side, a dorsal side, a little finger receiving portion, ring finger receiving portion, middle finger receiving portion index finger receiving portion, and thumb receiving portion, each of the little finger receiving portion, ring finger receiving portion, middle finger receiving portion index finger receiving portion, and thumb receiving portion being encapsulated in a liner section of fabric, the liner section of fabric at said thumb receiving portion being attached to said band portion by a circumscribing section of stretch material;

a cuff portion partially encircling the lower wrist portion; and a plurality of shock absorbing foam cushions attached to said hand portion; and a lower wrist portion attached to said hand portion and extending down from said wrist crease, wherein said lower wrist portion comprises a protective pad formed of dual density molded foam including a thin-gauge, high-density upper layer sewn to said liner section of fabric and at least one low-density foam pad co-molded onto the upper layer.

23. The protective sports glove according to claim 22, wherein said protective pad includes a plurality of low-density foam pads molded onto the upper layer and separated by interstitial hinged areas for flexibility.

24. The protective sports glove according to claim 22, wherein said plurality of shock absorbing foam cushions includes:

a first section of thin-gauge foam;

a second section of thin-gauge foam overlying said first section of thin-gauge foam;

a third second section of polymer sheet overlying said second section of thin-gauge foam; and a fabric material at least partially encapsulating said first section, second section, and third section in a sandwich configuration.

25. The protective sports glove according to claim 24, wherein said third section of polymer sheet has a durometer higher than said first section and second section of thin-gauge foam.

26. The protective sports glove according to claim 25, wherein said third section of polymer sheet comprises a polyethylene sheet.

27. The protective sports glove according to claim 25, wherein said first section of thin-gauge foam has a durometer lower than said second section of thin-gauge foam.

28. The protective sports glove according to claim 1, wherein said lower wrist portion is attached to said hand portion on said dorsal side by a first gusset comprising a strip of stretch material.

29. The protective sports glove according to claim 22, wherein the wrist cushion of said lower wrist portion is attached to said hand portion on said dorsal side by a first gusset comprising a strip of stretch material.

30. The protective sports glove according to claim 22, wherein the wrist cushion of said lower wrist portion is attached to said hand portion on said dorsal side by a first gusset comprising a strip of stretch material, and wherein the cuff portion of said lower wrist portion is attached to said collar by a second gusset comprising a strip of stretch material.

31. The protective sports glove according to claim 22, wherein the cuff portion of said lower wrist portion is attached to said collar by stitching said collar directly onto said lower wrist portion.

32. The protective sports glove according to claim 22, wherein said plurality of shock absorbing foam cushions includes a thumb pad sewn to the liner overarching a distal tip of said thumb receiving portion.

33. A protective sports glove comprising:

a hand portion configured for covering a user's hand inclusive of fingers, thumb and carpometacarpal joints and configured for extending down approximately to a wrist crease of said user's hand, said hand portion including a palmar side, a dorsal side, a little finger receiving portion, ring finger receiving portion, middle finger receiving portion, index finger receiving portion, and thumb receiving portion, each of the little finger receiving portion, ring finger receiving portion, middle finger receiving portion, index finger receiving portion, and thumb receiving portion being encapsulated in a liner section of fabric, wherein said liner section of fabric comprises a palmar section and a dorsal section, and the palmar section of said liner section of fabric comprises a plurality of discrete liner cuts sewn together including a first liner cut spanning said little finger receiving portion, ring finger receiving portion, and index finger receiving portion, a second liner cut spanning said thumb receiving portion, and a third liner cut configured to span a palm of said user's hand, and the liner section of fabric at said thumb receiving portion is attached to said hand portion by a circumscribing section of stretch material;

a lower wrist portion attached to said hand portion and configured for extending down from said wrist crease;

a cuff portion partially encircling the lower wrist portion;

a plurality of shock absorbing foam cushions attached to said hand portion.

34. The protective sports glove according to claim 33, wherein said first liner cut includes opposing marains extending beyond said finger receiving portions, said margins being sewn beneath the dorsal section of said liner section of fabric.

35. The protective sports glove according to claim 33, wherein said first liner cut is shaped as a crescent configured to conform to a palmar crease of the user's hand.

36. The protective sports glove according to claim 35, wherein said third liner cut is shaped as a crescent configured to conform to a palmar crease of the user's hand.

37. The protective sports glove according to claim 33, wherein said second liner cut is configured to extend along a curvilinear edge at a base of said user's thumb.

38. The protective sports glove according to claim 35, wherein said second liner cut is attached to said third liner cut by a gusset comprising a strip of stretch material.

39. A protective sports glove, comprising:

a hand portion configured to cover a user's hand inclusive of fingers, thumb and carpometacarpal joints and extending down approximately to a wrist crease of said user's hand, said hand portion including a palmar side, a dorsal side, a little finger receiving portion, ring finger receiving portion, middle finger receiving portion, index finger receiving portion, and thumb receiving portion, said band portion also including a fabric liner;

a lower wrist portion attached to said hand portion and configured to extend down from said wrist crease of said user's hand;

a cuff portion partially encircling the lower wrist portion;

a plurality of shock absorbing foam cushions attached to said hand portion, at least one of said plurality of shock absorbing foam cushions comprising a dual-durometer molded foam block comprising a thin-gauge, high-density upper layer and at least one low-density foam pad co-molded onto the upper layer.

40. The protective sports glove according to claim 39, wherein said at least one dual-durometer molded foam block comprises a wart pad formed in a concave quadrilateral shape.

41. The protective sports glove according to claim 40, wherein said wart pad comprises a peripheral flange sewn to said liner fabric.

42. The protective sports glove according to claim 40, wherein said wart pad comprises a unitary molded shape defined by a plurality of concave bubbles.

43. The protective sports glove according to claim 40, wherein said fabric liner underlying said wart pad comprises an opening.

44. A lacrosse glove having a liner and a plurality of pads sewn to said liner, a flexible pad comprising:

a first foam block covered by a first fabric section, said first fabric section being sewn along three contiguous margins to said liner to encapsulate sad first foam block there between and said first fabric section including an unsewn marginal tab; and a second foam block covered by a second fabric section, said second fabric section being sewn along three contiguous margins to said liner to encapsulate said second foam block there between, and said second fabric section including an unsewn marginal tab;

the marginal tab of said first fabric section being longer than the marginal tab of the second fabric section and tucked there beneath.

* * * * *